US010871009B2

(12) United States Patent
Alexander et al.

(10) Patent No.: US 10,871,009 B2
(45) Date of Patent: Dec. 22, 2020

(54) SHAPE MEMORY ALLOY LATCHING AND LOCKING CLOSURE SYSTEM

(71) Applicant: GM Global Technology Operations LLC, Detroit, MI (US)

(72) Inventors: Paul W. Alexander, Ypsilanti, MI (US); Dayananda Narasimhaiah, Franklin, MI (US); Matthew M. Stack, Macomb Township, MI (US); Wonhee M. Kim, Royal Oak, MI (US); Alejandro Garcia, Mission Viejo, CA (US); James H. Brown, Irvine, CA (US); Yonghoon Shim, Seoul (KR); Jaehun Kim, Incheon (KR)

(73) Assignee: GM Global Technology Operations, LLC, Detroit, MI (US)

( * ) Notice: Subject to any disclaimer, the term of this patent is extended or adjusted under 35 U.S.C. 154(b) by 228 days.

(21) Appl. No.: 16/055,503

(22) Filed: Aug. 6, 2018

(65) Prior Publication Data

US 2020/0040609 A1 Feb. 6, 2020

(51) Int. Cl.

| | |
|---|---|
| ***E05B 51/00*** | (2006.01) |
| ***E05C 19/02*** | (2006.01) |
| ***E05B 47/00*** | (2006.01) |
| ***E05B 81/04*** | (2014.01) |
| *E05B 83/34* | (2014.01) |
| *E05B 83/30* | (2014.01) |
| *E05B 83/32* | (2014.01) |

(52) U.S. Cl.

CPC ..... *E05B 51/005* (2013.01); *E05B 47/0009* (2013.01); *E05B 81/04* (2013.01); *E05C 19/022* (2013.01); *E05B 83/30* (2013.01); *E05B 83/32* (2013.01); *E05B 83/34* (2013.01)

(58) Field of Classification Search

CPC .... E05B 51/005; E05B 47/0009; E05B 81/04; E05B 83/28; E05B 83/03; E05B 83/32; E05B 83/34; E05C 19/022

USPC ..... 70/277; 292/63, 65, 169, 170, DIG. 37

See application file for complete search history.

(56) References Cited

U.S. PATENT DOCUMENTS

| | | | | |
|---|---|---|---|---|
| 3,832,243 A * | 8/1974 | Donkersloot et al. | .... | C22C 1/02 148/402 |
| 4,763,937 A * | 8/1988 | Sittnick, Jr. | ..... | E05B 49/00 292/251.5 |
| 6,786,070 B1 * | 9/2004 | Dimig | ..... | E05B 77/30 292/201 |

(Continued)

*Primary Examiner* — Suzanne L Barrett

(57) ABSTRACT

A lockable latching device includes a body defining a cavity and a plunger disposed within a cavity defined in the body. The plunger is translatable with respect to the body between an open position and a closed position. The lockable latching device also includes an annular rotator configured for rotating the plunger about a central longitudinal axis, and an annular latch transitionable between an unlocked state and a locked state. The lockable latching device further includes first and second elements. The lockable latching device also includes a force transmission mechanism operably connected to the first element, the second element, and the annular latch, with the force transmission mechanism configured to transition the annular latch from the unlocked state to the locked state in response to a first activation signal, and to transition the annular latch from the locked state to the unlocked state in response to a second activation signal.

20 Claims, 7 Drawing Sheets

(56) References Cited

U.S. PATENT DOCUMENTS

| | | | | |
|---|---|---|---|---|
| 7,152,892 | B2 * | 12/2006 | Rechberg | A47G 25/065 292/304 |
| 10,081,969 | B2 * | 9/2018 | Alexander | F03G 7/065 |
| 10,161,167 | B2 * | 12/2018 | Alexander | E05B 83/28 |
| 2004/0069028 | A1 * | 4/2004 | Dimig | E05B 83/36 70/277 |
| 2004/0104580 | A1 * | 6/2004 | Spiessl | F03G 7/065 292/84 |
| 2006/0012191 | A1 * | 1/2006 | Brei | E05B 47/0009 292/341.17 |
| 2009/0043253 | A1 * | 2/2009 | Podaima | G16H 10/60 604/67 |
| 2014/0339834 | A1 | 11/2014 | Alexander et al. | |
| 2015/0013398 | A1 * | 1/2015 | Taylor | E05B 47/0009 70/20 |
| 2015/0052728 | A1 | 2/2015 | Alexander et al. | |
| 2015/0300055 | A1 | 10/2015 | Alexander et al. | |
| 2019/0017216 | A1 * | 1/2019 | Dirnberger | D06F 39/14 |

* cited by examiner

SHAPE MEMORY ALLOY LATCHING AND LOCKING CLOSURE SYSTEM

INTRODUCTION

The present disclosure relates to a lockable latching device.

Storage and transportation devices often include a closure configured to cover a compartment. For example, a vehicle may include closures such as a glove box, a fuel filler compartment, a storage console, and the like. Such closures generally include a latch mechanism configured for latching and unlatching the closure. It may be desirable to have the ability to lock the enclosure to prevent unauthorized access. It may also be desirable to control locking and unlocking of the closure remotely, for example by actuating an electrical switch that is located some distance from the closure.

Thus, while current lockable latching devices achieve their intended purpose, there is a need for a new and improved system and method for a lockable latching device.

SUMMARY

According to several aspects, a lockable latching device includes a body defining a cavity therein and having a central longitudinal axis, and a plunger disposed within the cavity and having a first end and a second end spaced apart from the first end. The plunger is translatable with respect to the body along the central longitudinal axis between an open position in which the second end is disposed within the cavity and a closed position in which the second end protrudes from the cavity. The lockable latching device also includes an annular rotator disposed along the central longitudinal axis and configured for rotating the plunger about the central longitudinal axis, and an annular latch abutting the annular rotator and transitionable between an unlocked state in which the annular latch is positioned about the central longitudinal axis such that the plunger is transitionable between the open position and the closed position and a locked state in which the annular latch is positioned about the central longitudinal axis such that the plunger is not transitionable between the open position and the closed position. The lockable latching device further includes a first element formed from a first shape memory alloy (SMA) that is transitionable between a first austenite crystallographic phase and a first martensite crystallographic phase in response to a first activation signal, with the first element having a first end affixed relative to the body and a second end affixed relative to the body such that the first end of the first element is at a fixed location relative to the second end of the first element. The lockable latching device also includes a second element operably connected to the annular latch and formed from a second shape memory alloy that is transitionable between a second austenite crystallographic phase and a second martensite crystallographic phase in response to a second activation signal, with the second element having a first end affixed relative to the body and a second end affixed relative to the body such that the first end of the second element is at a fixed location relative to the second end of the second element. The lockable latching device also includes a force transmission mechanism operably connected to the first element, the second element, and the annular latch, with the force transmission mechanism configured to transition the annular latch from the unlocked state to the locked state in response to the first activation signal, and with the force transmission mechanism further configured to transition the annular latch from the locked state to the unlocked state in response to the second activation signal.

In an additional aspect of the present disclosure, the force transmission mechanism comprises a slider configured to move relative to the body, wherein the slider is urged to move in a first linear direction by the first element in response to the first activation signal and wherein the slider is urged to move in a second linear direction opposite the first linear direction in response to the second activation signal.

In another aspect of the present disclosure, the force transmission mechanism further comprises a lever rotatable about a pivot axis that is fixed relative to the body, wherein the lever is urged by the slider to rotate in a first rotational direction in response to the first activation signal and wherein the lever is urged by the slider to rotate in a second rotational direction opposite the first rotational direction in response to the second activation signal.

In a further aspect of the present disclosure, the lever is operably coupled to the annular latch.

In another aspect of the present disclosure, the lever is operably coupled to the annular latch by a compliant coupling configured to elastically deform if the annular latch is prevented from moving.

In yet another aspect of the present disclosure, the compliant coupling includes a strain relief ring coupled to the annular latch.

In another aspect of the present disclosure, the compliant coupling includes a spring member extending from the lever to the annular latch.

In a further aspect of the present disclosure, the lever rotates within a plane that is parallel with the central longitudinal axis.

In yet another aspect of the present disclosure, an electrical terminal affixed to and moveable with the slider is configured to cooperate with an electrical circuit to remove the first activation signal or the second activation signal when the slider moves past a predetermined position.

In a further aspect of the present disclosure, the lockable latching device further includes a detent spring configured to maintain the annular latch in its most recently commanded locked state or unlocked state in the absence of both the first activation signal and the second activation signal.

In another aspect of the present disclosure, the lockable latching device further includes an electrical circuit configured to receive a DC voltage and to provide the first activation signal if the DC voltage has a first polarity and to provide the second activation signal if the DC voltage has a second polarity that is opposite the first polarity.

According to several aspects, an actuator includes a body and a first element formed from a first shape memory alloy that is transitionable between a first austenite crystallographic phase and a first martensite crystallographic phase in response to a first activation signal, with the first element having a first end affixed relative to the body and a second end affixed relative to the body such that the first end of the first element is at a fixed location relative to the second end of the first element. The actuator also includes a second element formed from a second shape memory alloy that is transitionable between a second austenite crystallographic phase and a second martensite crystallographic phase in response to a second activation signal, with the second element having a first end affixed relative to the body and a second end affixed relative to the body such that the first end of the second element is at a fixed location relative to the second end of the second element. The actuator further includes a force transmission mechanism operably connected to the first element and the second element.

In another aspect of the present disclosure, the force transmission mechanism of the actuator includes a slider configured to move relative to the body, wherein the slider is urged by the first element to move in a first linear direction in response to the first activation signal and wherein the slider is urged by the second element to move in a second linear direction opposite the first linear direction in response to the second activation signal.

In a further aspect of the present disclosure, the force transmission mechanism of the actuator also includes a lever rotatable about a pivot axis that is fixed relative to the body. The lever is urged by the slider to rotate in a first rotational direction in response to the first activation signal and the lever is urged by the slider to rotate in a second rotational direction opposite the first rotational direction in response to the second activation signal.

In yet another aspect of the present disclosure, an electrical terminal affixed to and moveable with the slider is configured to cooperate with an electrical circuit to remove the first activation signal or the second activation signal when the slider moves past a predetermined position.

In a further aspect of the present disclosure, the actuator includes a detent spring configured to maintain the force transmission mechanism in its most recently commanded position in the absence of both the first activation signal and the second activation signal.

In another aspect of the present disclosure, the actuator includes an electrical circuit configured to receive a DC voltage. The electrical circuit is configured to provide the first activation signal if the DC voltage has a first polarity and to provide the second activation signal if the DC voltage has a second polarity that is opposite the first polarity.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
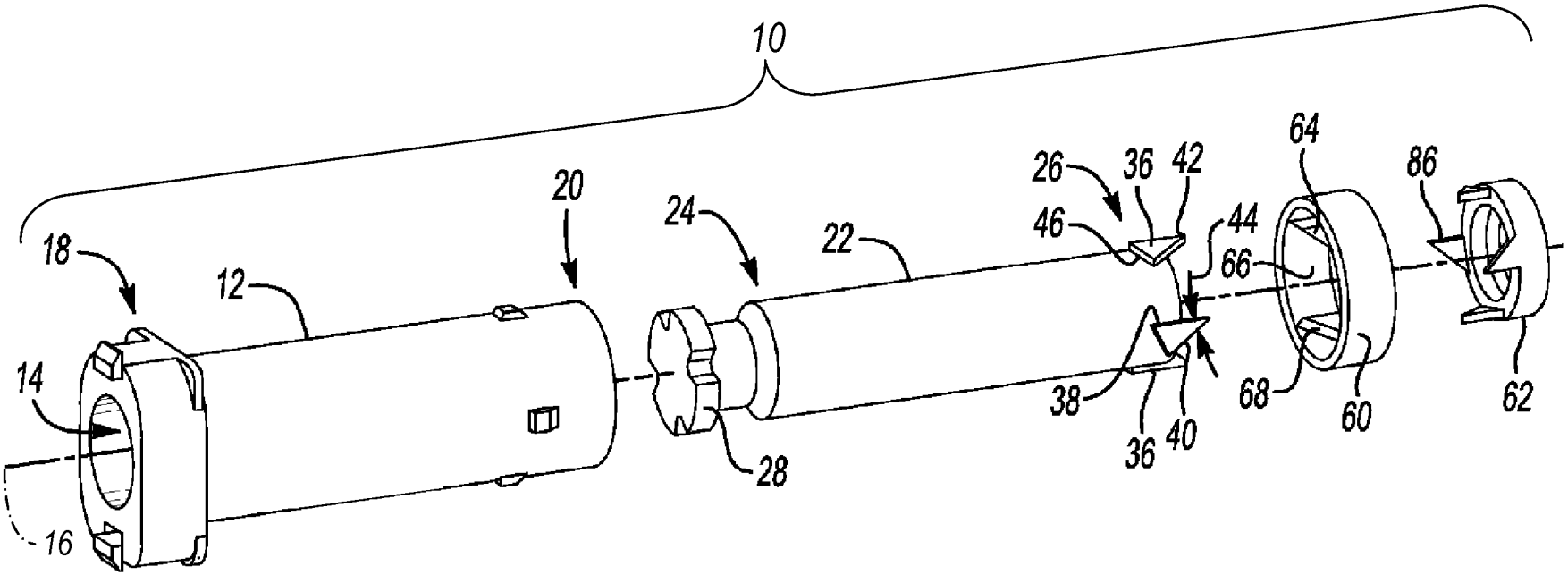
FIG. 1 is an illustration of an exploded view of portions of a lockable latching device according to an exemplary embodiment.

Referring to the Figures, wherein like reference numerals refer to like elements, a lockable latching device is shown at 10 in FIG. 1. The lockable latching device 10 is both latchable, i.e., closeable or fastenable, and lockable. That is, the lockable latching device 10 may open, close, lock, and unlock. Therefore, the lockable latching device 10 may be useful for closures for storage and transportation applications. For example, the lockable latching device 10 may be useful for vehicle applications such as fuel filler doors, glove boxes, storage bins, consoles, and the like. However, the lockable latching device 10 may also be useful for non-vehicular storage applications such as cabinetry, lockers, safes, and the like.

Referring to FIG. 1, the lockable latching device 10 includes a body 12 defining a cavity 14 therein and having a central longitudinal axis 16. The body 12 may have a generally cylindrical shape and may protect other components of the lockable latching device 10 from contaminants during operation. The body 12 may have a proximal end 18 and a distal end 20 spaced apart from the proximal end 18 along the central longitudinal axis 16, and may be formed from a material such as metal or plastic according to the operating conditions of the lockable latching device 10.

The lockable latching device 10 also includes a plunger 22 disposed within the cavity 14 and having a first end 24 and a second end 26 spaced apart from the first end 24. The plunger 22 may also have a generally cylindrical shape and may slide within the cavity 14 along the central longitudinal axis 16. The first end 24 may be configured for engaging a door (not shown) of a closure (not shown), such as, for example, a fuel filler door of a vehicle. The first end 24 may define a plurality of members 28 configured for mating with a corresponding one of a plurality of grooves (not shown) defined by the door. That is, the first end 24 may be keyed to the plurality of grooves. For example, as shown in FIG. 1, the plurality of members 28 may form a cross and may each align with and seat within a respective one of the plurality of grooves when an operator shuts or closes the door. Alternatively, the plurality of members 28 may form a star, circle, square, or other pattern or shape or arrangement to thereby align with or rest within the plurality of grooves during certain operating conditions. That is, as set forth in more detail below, the plunger 22 may rotate about the central longitudinal axis 16 during operation of the lockable latching device 10 so as to alternately align and unalign the plurality of members 28 with the plurality of grooves defined by the door and thereby join to the door to open or close the door. Conversely, the plurality of members 28 may not align with or seat within the respective one of the plurality of grooves when the plunger 22 rotates about the central longitudinal axis 16, e.g., when the door is opened. Further, although not shown, the lockable latching device 10 may also include a resilient member, such as a compression spring, that is configured for applying a constant force to the plunger 22 in an upward direction (denoted by arrow 30 in FIG. 5) along the central longitudinal axis 16.

Figure 2:
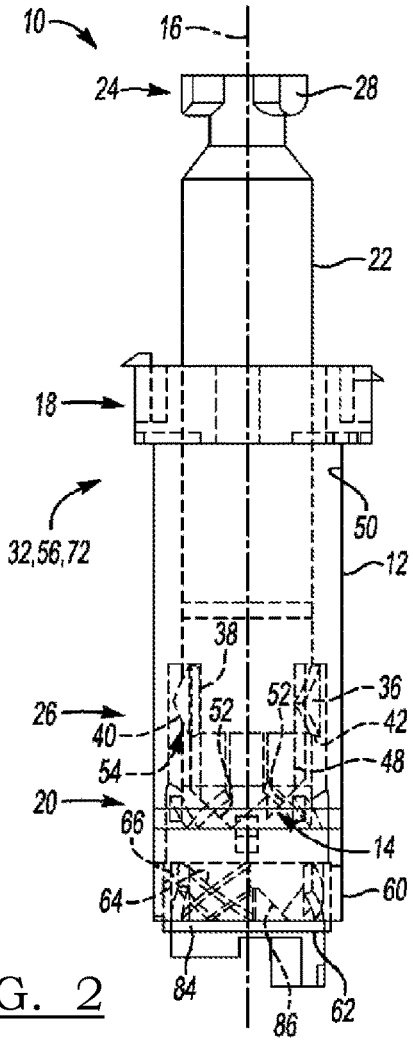
FIG. 2 is an illustration of a side view of a body, a plunger, an annular rotator, and an annular latch of the lockable latching device of FIG. 1, wherein the plunger is disposed in an open and unlatched position, according to an exemplary embodiment.
Figure 3:
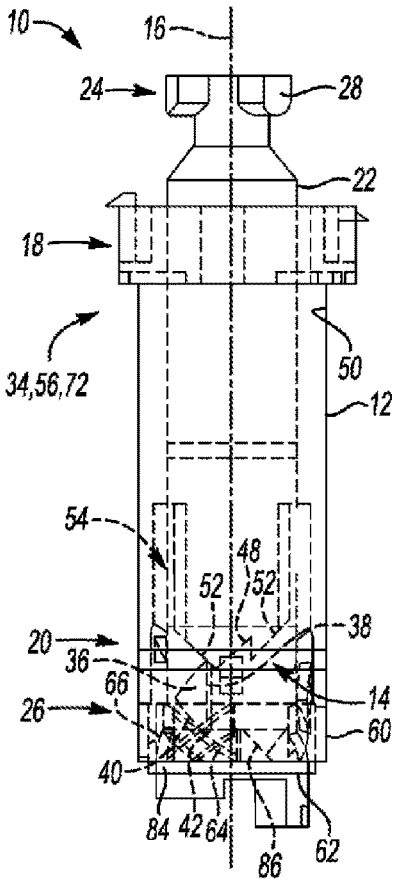
FIG. 3 is an illustration of a side view of the lockable latching device of FIG. 2, wherein the plunger is depressed towards the annular rotator and the annular latch, according to an exemplary embodiment.
Figure 4:
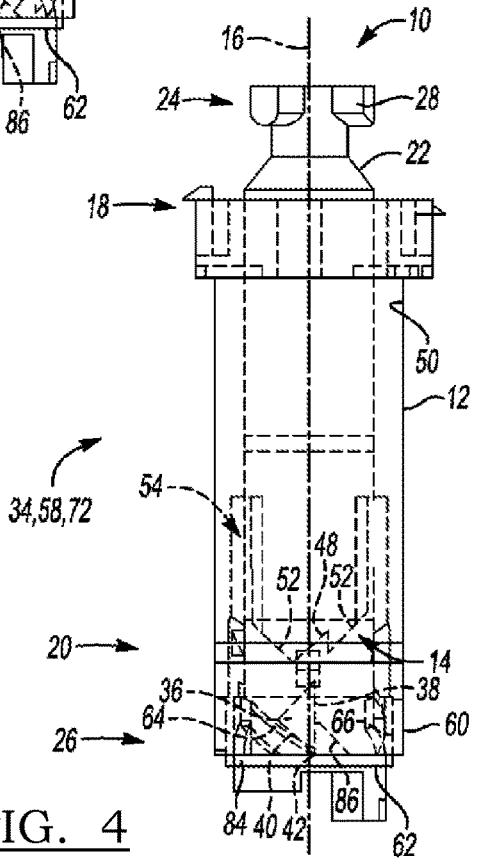
FIG. 4 is an illustration of a side view of the lockable latching device of FIG. 1, wherein the plunger is disposed in a closed position, according to an exemplary embodiment.

Referring now to FIGS. 2-4, the plunger 22 is translatable within the cavity 14. That is, the plunger 22 is translatable with respect to the body 12 along the central longitudinal axis 16 between an open position 32 (FIG. 2) in which the second end 26 is disposed within the cavity 14, and a closed position 34 (FIG. 4) in which the second end 26 protrudes from the cavity 14. For example, an operator may depress the plunger 22, e.g., by pressing against a door (not shown) or surface (not shown) mated to the first end 24 of the plunger 22, to thereby transition the plunger from the open position 32 to the closed position 34. Therefore, the plunger 22 may be disposed in the open position 32 when the door or surface of the closure (not shown) is also open or spaced apart from a complementary component (not shown) to which the door or surface latches and/or locks. Conversely, the plunger 22 may be disposed in the closed position 34 when the door or surface of the closure is also closed, e.g., latched and/or locked to, the complementary component. That is, when the plunger 22 is disposed in the open position 32, an operator may access a storage compartment (not shown) covered by the door or surface. However, when the plunger 22 is disposed in the closed position 34, the door or surface may seal off and cover the storage compartment.

Referring again to FIG. 1, the plunger 22 includes a plurality of legs 36 extending from the second end 26 and each spaced apart from one another about the central longitudinal axis 16. For example, the plunger 22 may include four legs 36. The plurality of legs 36 may interact with the body 12 as the plunger 22 is depressed and translates between the open position 32 (FIG. 2) and the closed position 34 (FIG. 4), as set forth in more detail below.

As best shown in FIGS. 3-6, each of the plurality of legs 36 may be generally triangular-shaped. More specifically, each of the plurality of legs 36 may include a first edge 38 that is substantially parallel to the central longitudinal axis 16, and a second edge 40 intersecting the first edge 38 at a vertex 42 that is spaced apart from the second end 26. The first edge 38 and the second edge 40 may define an acute angle 44 (FIG. 1) therebetween. That is, the second edge 40 may slope away from the first edge 38 at less than 90°. Further, each of the plurality of legs 36 may include a third edge 46 connecting the first edge 38 and the second edge 40.

Figure 5:
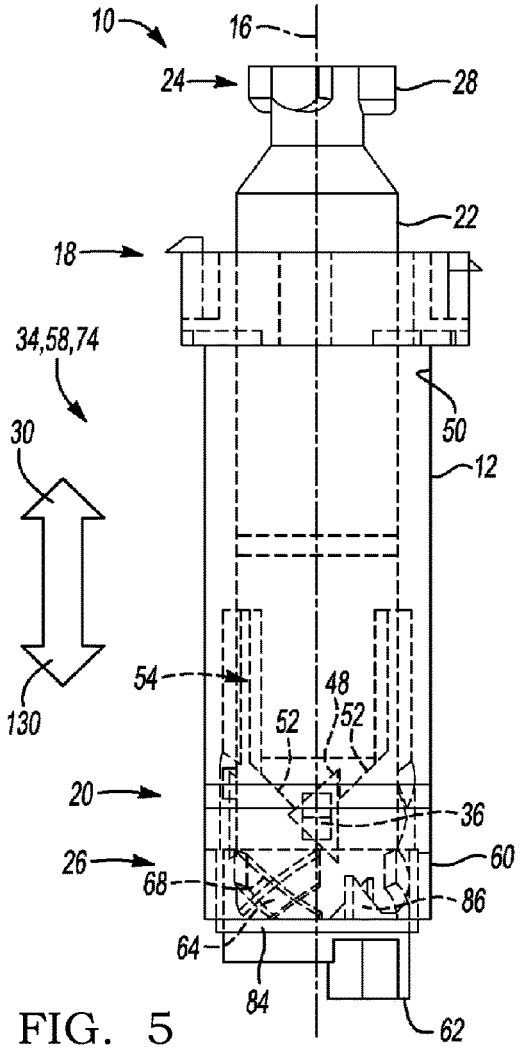
FIG. 5 is an illustration of a side view of the lockable latching device of FIG. 4, wherein the plunger is disposed in a closed and latched position, according to an exemplary embodiment.

Referring now to FIGS. 3 and 4, the body 12 may have an internal surface 50 facing the plunger 22 and may include a plurality of ribs 52 extending along the internal surface 50. Adjacent ones of the plurality of ribs 52 may define a retention notch 48 therebetween. Further, one of the plurality of legs 36 may mate with a retention notch 48 as the plunger 22 translates from the open position 32 (FIG. 2) to the closed position 34 (FIG. 4). For example, as best shown in FIG. 5, each of the plurality of legs 36 is able to abut with a respective one of the plurality of retention notches 48 when the plunger 22 is disposed in the closed position 34. That is, each leg 36 may contact the respective retention notch 48 so that the plunger 22 may no longer translate along the central longitudinal axis 16 in an upward direction 30, i.e., toward the proximal end 18 of the body 12. Therefore, after an operator initially depresses the plunger 22, e.g., by pressing against the door (not shown) or surface mated to the first end 24 to shut the door against a complementary component (not shown) to thereby enclose and cover a storage compartment (not shown), the plunger 22 may remain depressed within the cavity 14 since each of the plurality of legs 36 may rest against a respective one of the plurality of retention notches 48.

As described with continued reference to FIGS. 3 and 4, the internal surface 50 may further define a plurality of release channels 54 therein, wherein adjacent ones of the plurality of release channels 54 are spaced apart from one another by the plurality of ribs 52. Each of the plurality of legs 36 may be translatable within a respective one of the plurality of release channels 54 when the plunger 22 is disposed in the open position 32 (FIG. 2). That is, as described with reference to FIG. 2 and set forth in more detail below, when the plunger 22 is disposed in the open position 32, each leg 36 may not contact the respective retention notch 48, but may instead be translatable within the respective release channel 54 so that the plunger 22 may travel along the central longitudinal axis 16 in an upward direction 30, i.e., toward the proximal end 18 of the body 12 or in a downward direction (denoted by arrow 130 in FIG. 5), i.e., toward the distal end 20 of the body 12. Therefore, when the plurality of legs 36 are disposed within a respective one of the plurality of release channels 54, after an operator again depresses the plunger 22, e.g., by again pressing against the door (not shown) or surface mated to the first end 24, the plunger 22 may pop up within the cavity 14 since each of the plurality of legs 36 may travel within a respective one of the plurality of release channels 54.

Referring now to FIGS. 2-6, during certain circumstances, the plunger 22 may also be rotatable about the central longitudinal axis 16 as the plunger 22 is depressed, i.e., as the plunger 22 translates along the central longitudinal axis 16 in the downward direction 130 (FIG. 5). In particular, the plunger 22 may be rotatable between an unlatched position 56 (FIGS. 2 and 3) in which one of the plurality of legs 36 is positioned about the central longitudinal axis 16 so that the one of the plurality of legs 36 is not abuttable with, i.e., not vertically aligned with, the retention notch 48 as the plunger 22 translates towards the distal end 20, and a latched position 58 (FIGS. 4-6) in which the one of the plurality of legs 36 is positioned about the central longitudinal axis 16 so that the one of the plurality of legs 36 is abuttable with, i.e., is aligned with, the retention notch 48 as the plunger 22 translates towards the proximal end 18. That is, a respective one of the plurality of legs 36 may abut the retention notch 48 when the plunger 22 is disposed in the latched position 58. In contrast, each of the plurality of legs 36 may be translatable within a respective one of the plurality of release channels 54 when the plunger 22 is disposed in the unlatched position 56. The unlatched position 56 of the plunger 22 may correspond to a condition in which the door (not shown) or surface of the closure (not shown) is open and not sealed against a complementary component (not shown) so that a storage compartment (not shown) is accessible. Conversely, the latched position 58 of the plunger 22 may correspond to an opposite condition in which the door or surface of the closure is closed and mated against the complementary component so that the storage compartment is covered and not accessible.

Therefore, the open position 32 and the closed position 34 of the plunger 22 each denote a vertical or longitudinal position of the plunger 22 within the cavity 14 along the central longitudinal axis 16, and the unlatched position 56 and the latched position 58 of the plunger 22 each denote a rotational position of the plunger 22 about the central longitudinal axis 16.

As such, referring to FIG. 2, during some operating conditions, it is to be appreciated that the plunger 22 may be disposed in both the open position 32, i.e., so that the second end 26 does not protrude from the cavity 14, and the unlatched position 56, i.e., in which each leg 36 is not aligned or abuttable with a respective one of the plurality of retention notches 48. This operating condition may correspond to a condition in which the door (not shown) or surface is open or pivoted away from the complementary component (not shown).

However, as shown in FIG. 3, after the plunger 22 is initially depressed, the plunger 22 may be disposed in both the closed position 34, i.e., wherein the second end 26 protrudes from the cavity 14, and the unlatched position 56, i.e., wherein the one of the plurality of legs 36 is not aligned or abuttable with a respective one of the plurality of retention notches 48. During such a condition, the plunger 22 may pop back up, i.e., travel in the upward direction 30 (FIG. 5) within the cavity 14 after the plunger 22 is initially depressed since the plurality of legs 36 may not abut a respective one of the plurality of retention notches 48.

Figure 6:
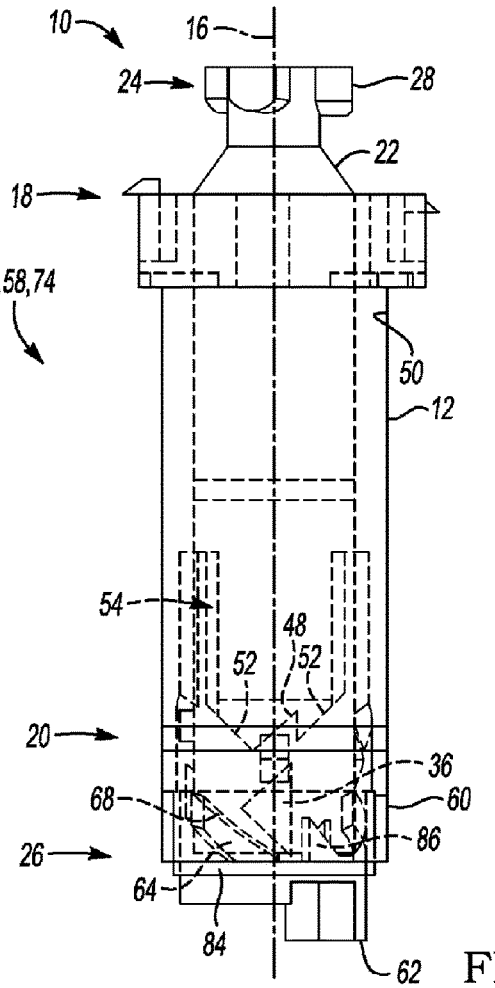
FIG. 6 is an illustration of a side view of the lockable latching device of FIG. 5, wherein the annular latch is in a locked state, according to an exemplary embodiment.

In contrast, during some operating conditions, as shown in FIGS. 4-6, the plunger 22 may be disposed in both the closed position 34, i.e., wherein the second end 26 protrudes from the cavity 14, and the latched position 58, i.e., wherein each leg 36 is abuttable with a respective one of the plurality of retention notches 48 so that the plunger 22 is retained along the central longitudinal axis 16. This operating condition may correspond to a condition in which the door (not shown) or surface is closed against or latched to the complementary component (not shown) to close off or cover the storage compartment (not shown).

Further, after the plunger 22 is again depressed for a second time, the plunger 22 may be disposed in both the closed position 34, i.e., wherein the second end 26 protrudes from the cavity 14, and the unlatched position 56, i.e., wherein the leg 36 is not aligned or abuttable with a respective one of the plurality of retention notches 48, so that each leg 36 may translate within a respective one of the plurality of release channels 54 as the plunger 22 travels in an upward direction 30 (FIG. 5) within the cavity 14. During such a condition, the plunger 22 may pop back up, i.e., travel in the upward direction 30 within the cavity 14 after the plunger 22 is again depressed since the plurality of legs 36 may not abut a respective one of the plurality of retention notches 48 and may therefore allow upwards translation of the plunger 22.

Referring again to FIG. 1, the lockable latching device 10 also includes an annular rotator 60 disposed along the central longitudinal axis 16 and configured for rotating the plunger 22 about the central longitudinal axis 16, as set forth in more detail below. In one non-limiting example, the annular rotator 60 may be spaced apart from the body 12 along the central longitudinal axis 16. The lockable latching device 10 further includes an annular latch 62 abutting the annular rotator 60 and configured for actuating release of the plunger 22 under certain operating conditions so that the plunger 22 may travel in the upward direction 30 (FIG. 5) within the cavity 14, as also set forth in more detail below. The annular rotator 60 may be disposed between the body 12 and the annular latch 62 about the central longitudinal axis 16.

As described with reference to FIGS. 2-4, the annular rotator 60 may include a plurality of ramps 64 each configured for guiding the vertex 42 of a respective one of the plurality of legs 36 towards the annular latch 62 as the plunger 22 rotates between the unlatched position 56 (FIGS. 2 and 3) and the latched position 58 (FIG. 4). That is, the annular rotator 60 may have an inside surface 66 that faces the plunger 22 and the inside surface 66 may define the plurality of ramps 64. The annular rotator 60 may include a number of ramps 64 corresponding to the number of legs 36 of the plunger 22, e.g., four. The plurality of ramps 64 may each have a sloped guide surface 68 and may be arranged radially about the central longitudinal axis 16 along the inside surface 66 of the annular rotator 60.

During operation, as described with reference to FIGS. 2-4, as the plunger 22 is first depressed or pushed in the downward direction 130 (FIG. 5) toward the distal end 20 of the body 12 along the central longitudinal axis 16, the plunger 22 translates within the cavity 14 towards the annular rotator 60. As shown in FIG. 3, as each leg 36 contacts a respective one of the plurality of ramps 64, each vertex 42 translates along the respective one of the plurality of ramps 64 to rotate the plunger 22 in a first direction 70 (FIG. 7) and translate the plunger 22 from the unlatched position 56 (FIGS. 2 and 3) to the latched position 58 (FIG. 4). That is, the annular rotator 60 guides the legs 36 and thereby turns the plunger 22 in the first direction 70, e.g., clockwise, about the central longitudinal axis 16 as the plunger 22 is initially depressed. Therefore, the annular rotator 60 converts the longitudinal travel of the plunger 22 into rotational motion, and positions the plunger 22 in a desired rotational position, i.e., the latched position 58, so that each leg 36 vertically aligns with each retention notch 48.

As such, as described by comparing FIGS. 4 and 5, after the operator releases the initial downward pressure on the plunger 22, e.g., after the operator senses that the door (not shown) or surface is properly mated or closed to the complementary component (not shown) so that the storage compartment (not shown) is covered, the plunger 22 may pop up slightly within the cavity 14 and yet be retained in the latched position 58 since each leg 36 abuts a respective one of the plurality of retention notches 48.

Referring now to FIGS. 4-7, the annular latch 62 is transitionable between an unlocked state 72 (FIG. 4) in which the annular latch 62 is positioned about the central longitudinal axis 16 such that the plunger 22 is transitionable between the open position 32 (FIG. 2) and the closed position 34 (FIG. 4), and a locked state 74 (FIG. 5) in which the annular latch 62 is positioned about the central longitudinal axis 16 such that the plunger 22 is not transitionable between the open position 32 and the closed position 34. The lockable latching device 10 may also include another resilient member (not shown), which may bias the annular latch 62 to the locked state 74 as a default or initial state.

Referring again to FIGS. 6 and 7, the annular latch 62 may include a plurality of sloped protrusions 86 extending from the annular base 84 toward the distal end 20, wherein each of the sloped protrusions 86 is spaced apart from one another about the central longitudinal axis 16. During operation, the vertex 42 of a respective one of the plurality of legs 36 may traverse along the respective one of the plurality of sloped protrusions 86 as the plunger 22 transitions from the closed position 34 (FIG. 6) to the open position 32 (FIG. 2) when the annular latch 62 is urged in a second direction 170, e.g. counterclockwise about the central longitudinal axis 16, by an actuator (not shown).

For example, referring again to FIG. 6, after the operator has transitioned the plunger 22 to the closed position 34, the operator may wish to re-open the door (not shown) or surface of the closure (not shown). To do so, the operator may reapply downward pressure to the plunger 22, i.e., push the plunger 22 towards the annular rotator 60 again, while the annular latch 62 is urged in the second direction 170 by the actuator (not shown). Therefore, as the vertex 42 contacts a respective one of the plurality of sloped protrusions 86, the sloped protrusion 86 may guide the vertex 42 in the downward direction 130, rotate the plunger 22 in the first direction 70, and thereby position the plunger 22 such that each of the plurality of legs 36 may eventually travel within a respective one of the plurality of release channels 54 as the plunger 22 rebounds in the upward direction 30 along the central longitudinal axis 16 when the operator releases downward pressure from the plunger 22.

Figure 7:
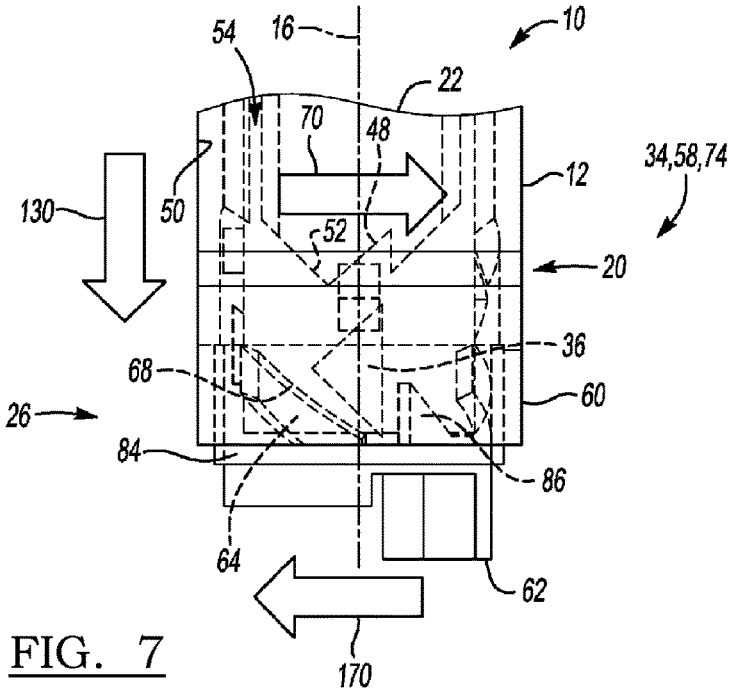
FIG. 7 is an illustration of a partial side view of the lockable latching device of FIG. 6, according to an exemplary embodiment.

For example, as described with reference to FIGS. 5-7, in one non-limiting embodiment, when the annular latch 62 is urged in the second direction 170 by the actuator (not shown), and the plunger 22 is concurrently pushed downward along the central longitudinal axis 16 so as to unseat from the plurality of retention notches 48, the plurality of legs 36 may be positioned to travel within the respective ones of the plurality of release channels 54. That is, since the annular latch 62 is urged in the second direction 170 by the actuator (not shown), the annular latch 62 may move about the central longitudinal axis 16 and thereby reposition the plurality of sloped protrusions 86 along the central longitudinal axis 16. Conversely, if the actuator (not shown) urges the annular latch 62 in the first direction 70, the annular latch 62 may not rotate about the central longitudinal axis 16 and the plunger 22 may only re-seat against the plurality of retention notches 48 once the downward pressure is removed from the plunger 22.

Consequently, as described with reference to FIG. 4, as the plunger 22 continues to translate in the downward direction 130 (FIG. 5), the vertex 42 of the each of the plurality of legs 36 may contact a respective one of the plurality of sloped protrusions 86, which have been newly repositioned about the central longitudinal axis 16 as the actuator urges the annular latch 62 in the second direction 170. The plurality of sloped protrusions 86 may therefore guide each vertex 42 in the downward direction 130 so that the plunger 22 consequently rotates about the central longitudinal axis 16 in the first direction 70. Therefore, since each leg 36 is no longer aligned with the respective one of the plurality of retention notches 48, when the downward pressure is again released from the plunger 22, the plunger 22 may pop up within the cavity 14 and each of the plurality of legs 36 may travel within a respective one of the plurality of release channels 54. Therefore, the plunger 22 may travel in the upward direction 30 so that the second end 26 no longer protrudes from the cavity 14 and the plunger 22 is disposed in the open position 32 (FIG. 2) to thereby open, e.g., unlatch and unlock, the door (not shown) or surface of the closure (not shown) from the complementary component (not shown).

Conversely, referring again to FIGS. 5-7, the plunger 22 may not be rotatable about the central longitudinal axis 16 in the second direction 170 when the actuator (not shown) urges the annular latch 62 in the first direction 70. Instead, as shown in FIG. 5, the annular latch 62 may be positioned apart from the leg 36 about the central longitudinal axis 16 when the actuator (not shown) urges the annular latch 62 in the first direction 70. Therefore, the closure (not shown) may remain locked such that the door (not shown) or surface is mated to the complementary component. That is, when the actuator (not shown) urges the annular latch 62 in the first direction 70, the annular latch 62 may not be triggered to reposition the plurality of sloped protrusions 86. Such a condition may be useful when it is desired that the closure remain locked while also allowing an operator to attempt to depress the plunger 22. That is, the plunger 22 may still be translatable away from the distal end 20 along the central longitudinal axis 16 when the plunger 22 is disposed in the closed position 34 and the actuator (not shown) urges the annular latch 62 in the first direction 70. However, as the operator again removes the downward pressure from the plunger 22, the plunger 22 may only re-translate along the central longitudinal axis 16 to again re-seat each leg 36 against a respective one of the plurality of retention notches 48. As such, the plunger 22 and door (not shown) or surface may remain in the closed position 34. That is, the door may be both latched and locked so that any attempt to unlatch the door is unsuccessful. Further, regardless of whether or not the actuator (not shown) urges the annular latch 62 in the first direction 70, the plunger 22 may nonetheless be translatable in the downward direction 130 along the central longitudinal axis 16. Therefore, regardless of whether or not the actuator urges the annular latch in the first direction 70, an operator may always close or latch the door (not shown) or surface against the complementary component (not shown) of the closure (not shown).

Therefore, in operation and described generally, when the annular latch 62 is in the unlocked state 72, the operator may first push against the plunger 22 so that the plunger 22 travels in the downward direction 130 within the cavity 14 along the central longitudinal axis 16. As the legs 36 of the plunger 22 contact the plurality of ramps 64 of the annular rotator 60, the plurality of ramps 64 may guide the legs 36 downward and in the first direction 70 to thereby rotate the plunger 22 about the central longitudinal axis 16 until each leg 36 is longitudinally aligned to abut and seat against a respective one of the plurality of retention notches 48. As the operator removes the applied downward pressure from the plunger 22, the plunger 22 may rebound in the upward direction 30 along the central longitudinal axis 16 until each leg 36 contacts the respective one of the plurality of retention notches 48 and thereby retains the plunger 22 in the latched position 58 so that the door (not shown) or surface may be closed or latched to the complementary component (not shown) of the closure.

Under one option, the operator may next attempt to open or unlatch the door (not shown) or surface from the complementary component (not shown) when the actuator (not shown) urges the annular latch 62 in the first direction 70. For this option, the operator may again push the plunger 22 in the downward direction 130 along the central longitudinal axis 16. However, since the actuator (not shown) urges the annular latch 62 in the first direction 70, the annular latch 62 may not be in the unlocked state 72 and the plurality of sloped protrusions 86 may not assist in rotating the plunger 22 again so that each leg 36 cannot travel toward and within the plurality of release channels 54. Rather, the annular latch 62 may not rotate, and the plunger 22 may again rebound in the upward direction 30 when the applied pressure is removed from the plunger 22 so that each leg 36 is again retained against a respective one of the plurality of retention notches 48. Consequently, the plunger 22 may not successfully open or unlatch the door (not shown) or surface.

It is noted that even if the operator once again depresses the plunger 22, e.g., perhaps in an attempt to open or unlatch the door (not shown) or surface from the complementary component (not shown), the plunger 22 will remain in the closed position 34 (FIG. 5) when the annular latch 62 is disposed in the locked state 74. That is, although the plunger 22 may again depress towards the annular rotator 60 in response to the secondary or additional downward pressure applied to the plunger 22 by the operator, the plunger 22 may not further rotate about the central longitudinal axis 16 when the annular latch 62 is disposed in the locked state 74. Rather, since the annular rotator 60 is stationary with respect to the body 12 and the plurality of ramps 64 are only aligned to guide the vertex 42 of each leg 36 into a position such that each leg 36 is positioned to abut the respective one of the plurality of retention notches 48, the plunger 22 is yet again retained against the plurality of retention notches 48 when the plunger 22 is again released in the upward direction 30 (FIG. 5). Therefore, the operator may depress and release the plunger 22 multiple times in succession after the initial push against the plunger 22, and yet the plunger 22 may not rotate to the unlatched position 56 until the annular latch 62 is actuated to the unlocked state 72.

Stated differently, in order to transition the plunger 22 from the closed position 34 to the open position 32 and thereby re-open the door (not shown) or surface mated to the complementary component (not shown) of the closure (not shown), two conditions must be satisfied: 1) downward pressure must be applied to the plunger 22, and 2) the annular latch 62 must be actuated so that the plunger 22 may rotate about the central longitudinal axis 16.

Under an alternative option, the operator may next attempt to open or unlatch the door (not shown) or surface from the complementary component (not shown) when the actuator (not shown) urges the annular latch 62 in the second direction 170. For this option, the operator may again push the plunger 22 in the downward direction 130 along the central longitudinal axis 16. As such, the annular latch 62 may transition to the unlocked state 72 and the plurality of sloped protrusions 86 may assist in rotating the plunger 22 so that each leg 36 may travel down a respective sloped protrusion 86 towards a respective release channel 54, and eventually travel upwards within the respective release channel 54. That is, the annular latch 62 may rotate in the second direction 170 and the plunger 22 may again rebound in the upward direction 30 when the applied pressure is removed from the plunger 22 so that each leg 36 is not retained against a respective one of the plurality of retention notches 48. Consequently, the plunger 22 may successfully open or unlatch the door (not shown) or surface.

As such, the lockable latching device 10 may be configured as a push-push latch that is both latchable and lockable. That is, a latching function of the lockable latching device 10 may be controlled by the plunger 22, the annular rotator 60, and the body 12, while a locking function of the lockable latching device 10 may be separately controlled by the annular latch 62, and the actuator. That is, the latching function may be de-coupled from the locking function.

Figure 8:
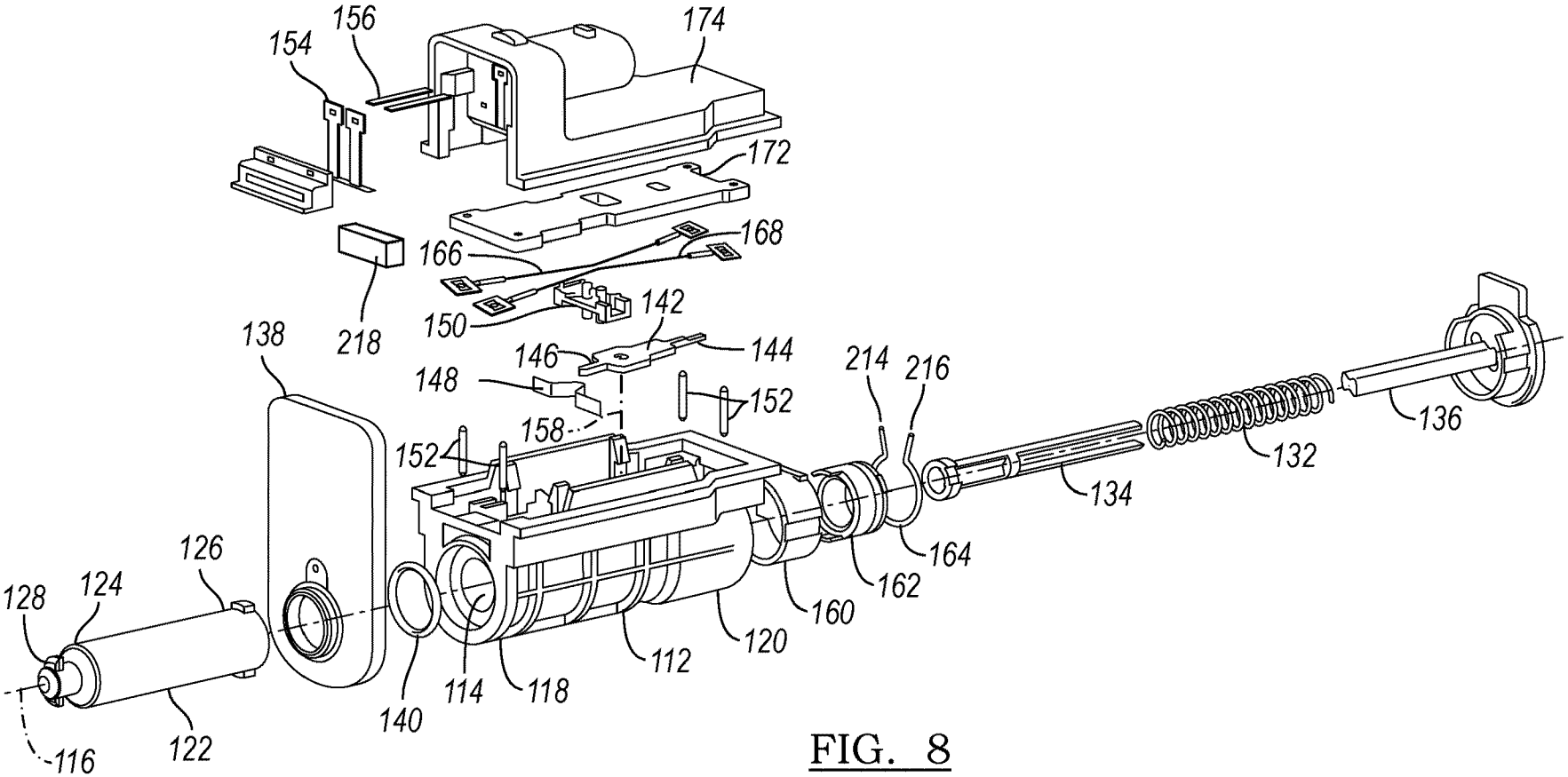
FIG. 8 is an exploded view of an alternative embodiment of a lockable latching device.

FIG. 8 is an exploded view of an alternate embodiment 110 of a lockable latching device. Referring to FIG. 8, the lockable latching device 110 includes a body 112 defining a cavity 114 therein and having a central longitudinal axis 116. The body 112 may have a generally cylindrical shape and may protect other components of the lockable latching device 110 from contaminants during operation. The body 112 may have a proximal end 118 and a distal end 120 spaced apart from the proximal end 118 along the central longitudinal axis 116, and may be formed from a plastic material according to the operating conditions of the lockable latching device 110.

The lockable latching device 110 also includes a plunger 122 disposed within the cavity 114 and having a first end 124 and a second end 126 spaced apart from the first end 124. The plunger 122 may also have a generally cylindrical shape and may slide within the cavity 114 along the central longitudinal axis 116. The first end 124 may be configured for engaging a door (not shown) of a closure (not shown), such as, for example, a fuel filler door of a vehicle. The first end 124 may define a plurality of members 128 configured for mating with a corresponding one of a plurality of grooves (not shown) defined by the door. That is, the first end 124 may be keyed to the plurality of grooves. For example, as shown in FIG. 8, the plurality of members 128 may form a pattern or shape or arrangement to thereby align with or rest within the plurality of grooves during certain operating conditions. That is, as set forth in more detail below, the plunger 122 may rotate about the central longitudinal axis 116 during operation of the lockable latching device 110 so as to alternately align and unalign the plurality of members 128 with the plurality of grooves defined by the door and thereby join to the door to open or close the door. Conversely, the plurality of members 128 may not align with or seat within the respective one of the plurality of grooves when the plunger 122 rotates about the central longitudinal axis 116, e.g., when the door is opened.

In the embodiment shown in FIG. 8, the lockable latching device 110 includes an upper cover 138 and an O-ring 140. The lockable latching device 110 also includes a resilient member in the form of a compression spring 132 that is configured for applying a force to the plunger 22 in a leftward direction in FIG. 8 along the central longitudinal axis 116. A spring joint 134 and a lower cover 136 allow compression of the compression spring 132 while preventing buckling.

With continued reference to FIG. 8, the lockable latching device 110 also includes an annular rotator 160 disposed along the central longitudinal axis 116. In one non-limiting example, the annular rotator 160 may be spaced apart from the body 112 along the central longitudinal axis 116. The lockable latching device 110 further includes an annular latch 162 abutting the annular rotator 160 and configured for actuating release of the plunger 122 under certain operating conditions so that the plunger 122 may travel in the upward direction 30 (FIG. 5) within the cavity 114. The annular rotator 160 may be disposed between the body 112 and the annular latch 162 about the central longitudinal axis 116. The embodiment of the lockable latching device depicted in FIG. 8 also includes a C-spring 164 having a first radially-projecting end 214 and a second radially-projecting end 216. The C-spring 164 is disposed on an outer surface of the annular latch 162 such that the C-spring 164 rotates with the annular latch 162.

The cavity 114 defined in the body 112 depicted in FIG. 8 includes has an internal surface analogous to the internal surface 50 of body 12 described earlier, upon which are defined a plurality of ribs (not shown) analogous to the ribs 52 and a plurality of release channels (not shown) analogous to the release channels 54 described earlier. Similarly the annular rotator 160 depicted in FIG. 8 includes an internal surface defining ramps analogous to the internal surface 66 of annular rotator 60 described earlier. The annular latch 162 includes protrusions analogous to the protrusions 86 of annular latch 62 described earlier. The body 112, the plunger 122, the annular rotator 160, and the annular latch 162 are thereby configured to cooperate to allow the open and closed, latched and unlatched, and locked and unlocked states described earlier with respect to FIGS. 2-7. It will be appreciated that the angles indicated in the description accompanying FIGS. 2-7 may be changed so that the directions of plunger rotation corresponding to latched and unlatched states and/or the directions of annular latch rotation corresponding to locked and unlocked states may be reversed without departing from the scope of the present disclosure.

With continued reference to FIG. 8, the lockable latching device 110 further includes an actuator comprising a lever 142, a slider 150, a first SMA element 166, and a second SMA element 168. As will be described below, the actuator comprising these components is operable to rotate the annular latch 162 in a manner analogous to the actuator described earlier in the discussion of FIGS. 4-7 as rotating the annular latch 62.

Continuing to refer to FIG. 8, the lockable latching device also includes a detent spring 148, a plurality of pins 152, electrical terminals 154, connector pins 156, an electrical circuit 172, and a connector body 174.

Figure 11:
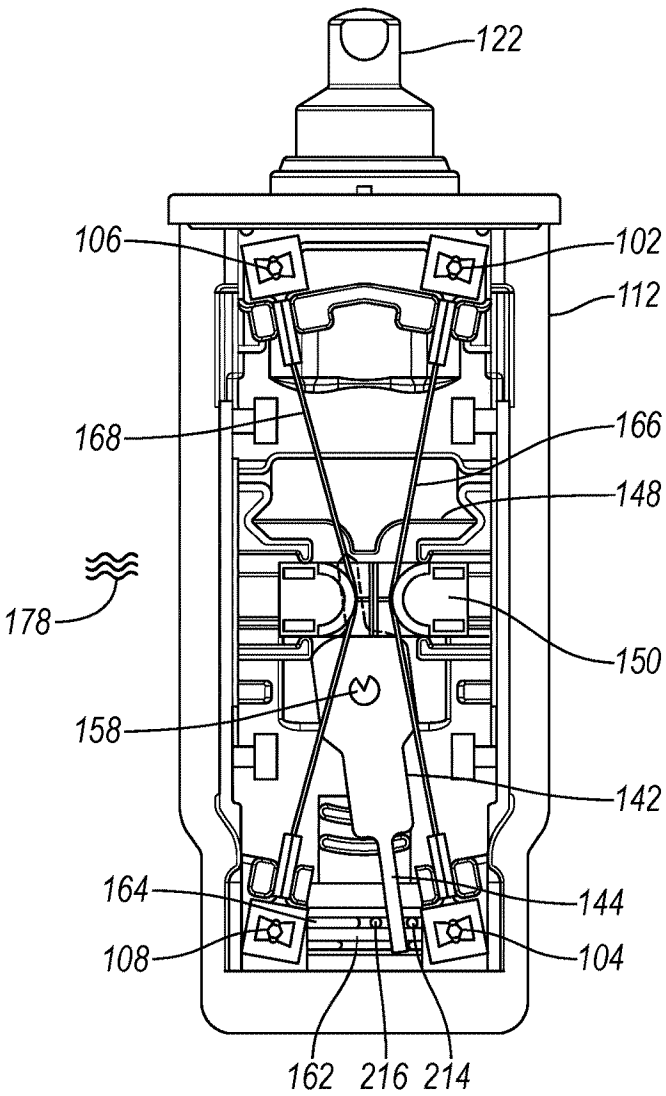
FIG. 11 is an illustration of the lockable latching device of FIG. 8 in which the annular latch is in an unlocked position. according to an exemplary embodiment.
Figure 10:
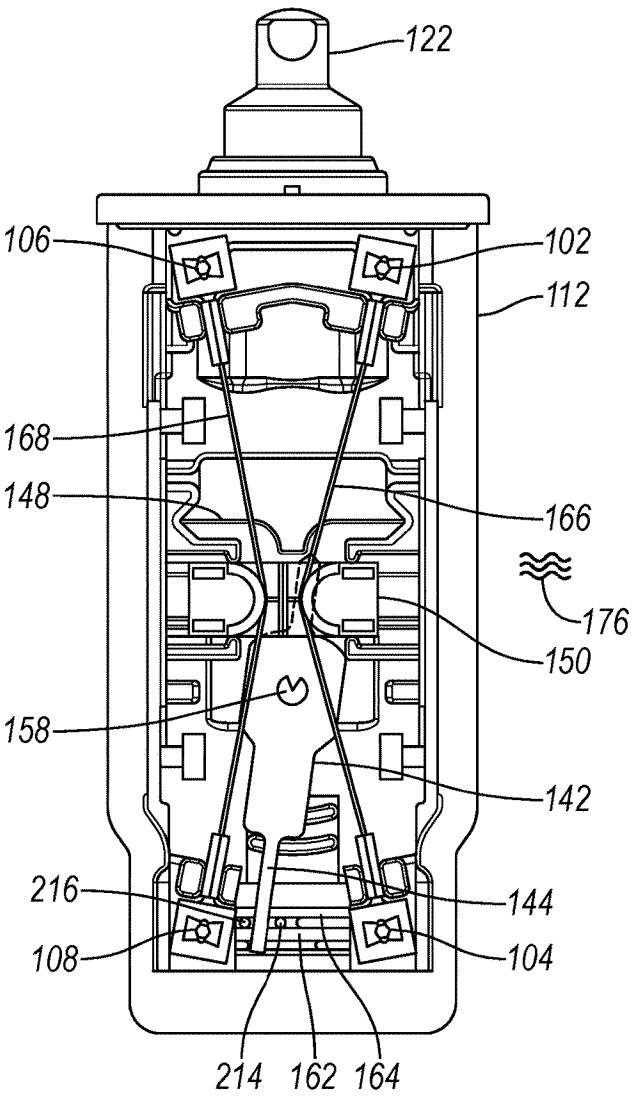
FIG. 10 is an illustration of the lockable latching device of FIG. 8 in which the annular latch is in a locked position.

As shown in FIGS. 10 and 11, the lockable latching device 110 includes a first element 166 operably connected to the annular latch 162 and formed from a first shape memory alloy. The first shape memory alloy is transitionable between a first martensite crystallographic phase and a first austenite crystallographic phase in response to a first activation signal 176 (FIG. 10), e.g., a thermal activation signal or heat, to thereby transition the annular latch 62 from an unlocked state (FIG. 11) to a locked state (FIG. 10). In the embodiment shown in FIGS. 10 and 11, a first end of the first element 166 is anchored to the body 112 at a first anchor point 102, and a second end of the first element 166 is anchored to the body 112 at a second anchor point 104.

The lockable latching device 110 also includes a second element 168 operably connected to the annular latch 62 and formed from a second shape memory alloy. The second shape memory alloy is transitionable between a second austenite crystallographic phase and a second martensite crystallographic phase in response to a second activation signal 178 (FIG. 11), e.g., a thermal activation signal or heat, to thereby transition the annular latch 62 from the locked state (FIG. 10) to the unlocked state (FIG. 11). In the embodiment shown in FIGS. 10 and 11, a first end of the second element 168 is anchored to the body 112 at a third anchor point 106, and a second end of the second element 168 is anchored to the body 112 at a fourth anchor point 108.

Figure 9A:
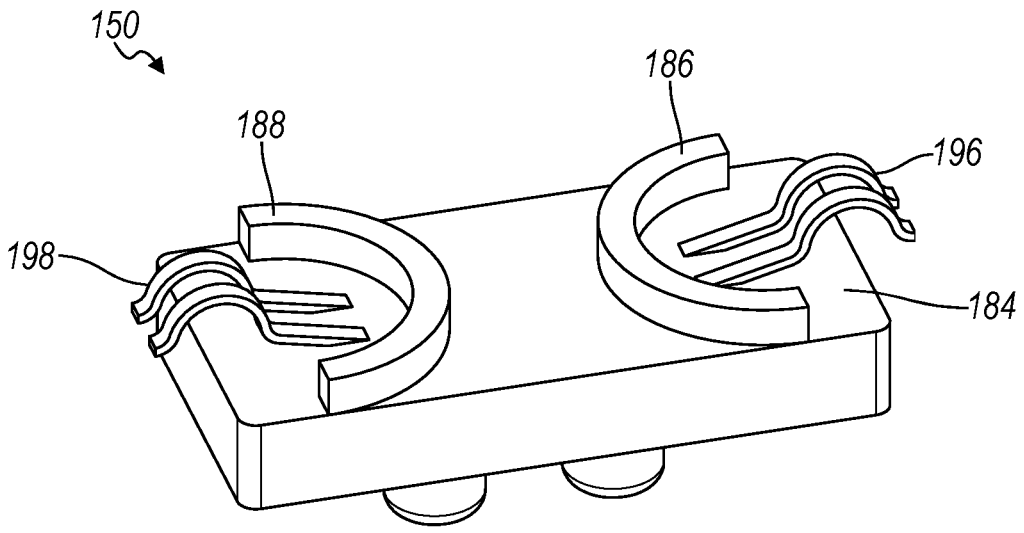
FIG. 9*a* and FIG. 9B are illustrations of a slider found in the exemplary embodiment of FIG. 8.
Figure 9B:
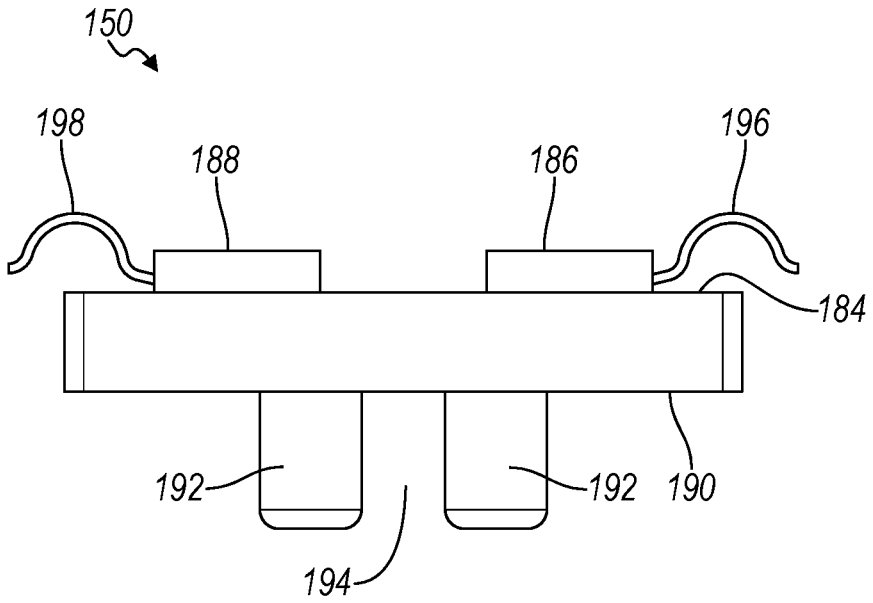

As shown in FIGS. 10 and 11, the first element 166 and the second element 168 are configured in an antagonistic bowstring configuration wherein sufficient contraction of the first element 166 applies a force to the slider 150 to urge the slider 150 in a first direction (rightward in FIGS. 10 and 11), and sufficient contraction of the second element 168 applies force to the slider 150 to urge the slider 150 in a second direction (leftward in FIGS. 10 and 11) opposite the first direction. As seen in FIGS. 9*a* and 9*b*, the slider 150 includes a top surface 184 from which a first wall 186 and a second wall 188 extend. The slider 150 also includes a bottom surface 190 from which two posts 192 extend, with a gap 194 defined between the posts 192. The slider 150 also carries a first electrical terminal 196 and a second electrical terminal 198 extending from the top surface 184. The function of the electrical terminals 196, 198 will be described later.

With continued reference to FIGS. 10 and 11, the embodiment of the lockable latching device 110 further includes a lever 142 that is rotatable about a pivot axis 158. In the embodiment shown, the lever 142 includes a first arm 144 and a second arm 146. The second arm 146 is configured to extend into the gap 194 between the posts 192 extending from the bottom surface 190 of the slider 150. Movement of the slider 150 according to whether the first element 166 or the second element 168 exerts a greater force on the slider 150 may cause one of the posts 192 to contact the second arm 146, thus urging the lever 142 to rotate about the pivot axis 158.

As used herein, the terminology "shape memory alloy" refers to alloys that exhibit a shape memory effect and have the capability to quickly change properties in terms of stiffness, spring rate, and/or form stability. That is, the shape memory alloy may undergo a solid state crystallographic phase change via molecular or crystalline rearrangement to shift between the martensite crystallographic phase, i.e., "martensite", and the austenite crystallographic phase, i.e., "austenite". Stated differently, the shape memory alloy may undergo a displacive transformation rather than a diffusional transformation to shift between martensite and austenite. A displacive transformation is defined as a structural change that occurs by the coordinated movement of atoms or groups of atoms relative to neighboring atoms or groups of atoms. In general, the martensite phase refers to the comparatively lower-temperature phase and is often more deformable than the comparatively higher-temperature austenite phase.

The temperature at which the shape memory alloy begins to change from the austenite crystallographic phase to the martensite crystallographic phase is known as the martensite start temperature, Ms. The temperature at which the shape memory alloy completes the change from the austenite crystallographic phase to the martensite crystallographic phase is known as the martensite finish temperature, Mf. Similarly, as the shape memory alloy is heated, the temperature at which the shape memory alloy begins to change from the martensite crystallographic phase to the austenite crystallographic phase is known as the austenite start temperature, As. The temperature at which the shape memory alloy completes the change from the martensite crystallographic phase to the austenite crystallographic phase is known as the austenite finish temperature, Af.

The shape memory alloy may have any suitable composition, and the first shape memory alloy may be the same as or different from the second shape memory alloy. In particular, the shape memory alloy may include in combination an element selected from the group of cobalt, nickel, titanium, indium, manganese, iron, palladium, zinc, copper, silver, gold, cadmium, tin, silicon, platinum, and gallium. For example, suitable shape memory alloys may include nickel-titanium based alloys, nickel-aluminum based alloys, nickel-gallium based alloys, indium-titanium based alloys, indium-cadmium based alloys, nickel-cobalt-aluminum based alloys, nickel-manganese-gallium based alloys, copper based alloys (e.g., copper-zinc alloys, copper-aluminum alloys, copper-gold alloys, and copper-tin alloys), gold-cadmium based alloys, silver-cadmium based alloys, manganese-copper based alloys, iron-platinum based alloys, iron-palladium based alloys, and combinations of one or more of each of these combinations. The shape memory alloy can be binary, ternary, or any higher order so long as the shape memory alloy exhibits a shape memory effect, e.g., a change in shape orientation, damping capacity, and the like. Generally, the first and second shape memory alloys may be selected according to desired operating temperatures of the lockable latching device 110. In one specific example, the first and/or second shape memory alloys may include nickel and titanium.

Therefore, the first element 166 formed from the first shape memory alloy and the second element 168 formed from the second shape memory element may be characterized by a cold state, i.e., when a temperature of the shape memory alloy is below the martensite finish temperature, Mf, of the shape memory alloy. Likewise, the first element 166 formed from the first shape memory alloy and the second element 168 formed from the second shape memory alloy may also be characterized by a hot state, i.e., when the temperature of the shape memory alloy is above the austenite finish temperature, Af, of the first and second shape memory alloys. In addition, although not shown, the lockable latching device 110 may include a plurality of first elements 166 formed from the first shape memory alloy and/or a plurality of second shape memory alloy elements 168 formed from the second shape memory alloy.

Referring again to FIG. 10, the first element 166 may contract in length in response to the first activation signal 176 to urge the slider 150 in a rightward direction. As the slider moves rightward, one of the posts 192 on the underside of the slider 150 contacts the second arm 146 of the lever 142, urging the lever 142 to rotate in a clockwise direction about the pivot axis 158. As the lever 142 rotates in a clockwise direction, the first arm 144, which is disposed in a gap between the first radially-projecting end 214 and the second radially-projecting end 216 of C-spring 164, contacts the second radially-projecting end 216 and urges the C-spring 164 to rotate in a leftward direction. The C-spring 164 is disposed on the external surface of the annular latch 162 such that rotation of the C-spring about the longitudinal axis 116 results in rotation of the annular latch 162 in a first direction about the longitudinal axis 116, e.g. counterclockwise about the central longitudinal axis 116 when viewed from the position of the lower cover 136. In an embodiment, counterclockwise rotation of the annular latch 162 corresponds to a locked state of the lockable latching device 110.

Similarly, referring to FIG. 11, the second element 168 may contract in length in response to the second activation signal 178 to urge the slider 150 in a leftward direction. As the slider moves leftward, the other of the posts 192 on the underside of the slider 150 contacts the second arm 146 of the lever 142, urging the lever 142 to rotate in a counterclockwise direction about the pivot axis 158. As the lever 142 rotates in a counterclockwise direction, the first arm 144, which is disposed in a gap between the first radially-projecting end 214 and the second radially-projecting end 216 of C-spring 164, contacts the first radially-projecting end 214 and urges the C-spring 164 to rotate in a rightward direction. The C-spring 164 is disposed on the external surface of the annular latch 162 such that rotation of the C-spring about the longitudinal axis 116 results in rotation of the annular latch 162 in a second direction about the longitudinal axis 116, e.g. clockwise about the central longitudinal axis 116 when viewed from the position of the lower cover 136. In an embodiment, clockwise rotation of the annular latch 162 corresponds to an unlocked state of the lockable latching device 110.

The second arm 146 extending from the lever 142 is configured to contact the detent spring 148. The detent spring 148 may exert a force on the second arm 146 of the lever 142 to hold the lever 142 in position at or near either extreme of rotation of the lever 142, i.e. when the annular latch 162 is in either of the unlocked state or the locked state. That is, the first element 166 and the second element 168 may alternately contract upon exposure to the respective first and second activation signals 176, 178 to thereby reposition the lever 142. However, it is to be appreciated that, once the lever 142 is positioned, the detent spring 148 may hold the lever 142 in place so that no continued first and second activation signals 176, 178 are required. That is, the first and second activation signals 176, 178 may be only momentary, and may not be continuously required to hold the annular latch 62 in position. As such, the configurations shown in FIGS. 10 and 11 may be indicative of which one of the first element 166 and the second element 168 was most recently activated even when neither the first activation signal 176 nor the second activation signal 178 is presently applied.

In the foregoing description the first activation signal 176 and the second activation signal 178 are described as thermal actuation or heat. In an advantageous embodiment, the first activation signal is generated by passing an electrical current through the first element 166, resulting in heat being generated within the first element 166 due to inherent electrical resistance of the first element 166. Similarly, the second activation signal is generated by passing an electrical current through the second element 168, resulting in heat being generated within the second element 168 due to inherent electrical resistance of the second element 168. Referring to FIG. 8, the electrical current may be provided through the connector pins 156, the terminals 154, and the electrical circuit 172. Pins 152 electrically connect the electrical circuit 172 to the first element 166 at the first anchor point 102 and at the second anchor point 104. Pins 152 also electrically connect the electrical circuit 172 to the second element 168 at the third anchor point 106 and at the fourth anchor point 108. In an embodiment of the disclosure, circuitry within the electrical circuit 172 determines whether electrical current is applied to the first element 166 or to the second element 168 based upon the polarity of a DC supply voltage applied across the connector pins 156. For example, a positive voltage across the connector pins may result in current being supplied to the first element 166, while a negative voltage across the connector pins may result in current being supplied to the second element 168.

To prevent permanent strain from occurring in the first element 166 and the second element 168, it is desirable to limit the heat applied to the first element 166 and the second element 168. The first electrical terminal 196 and the second electrical terminal 198 on the slider 150 (FIG. 9) are configured to cooperate with elements on the electrical circuit 172 to remove electrical current drive to the first element 166 or the second element 168 if it is determined by the position of the slider 150 that the temperature of the respective element is above a predetermined threshold. Due to the action of the detent spring 148 as described earlier, position of the lever 142 will be maintained even upon removal of electrical current from the first element 166 or the second element 168.

In the event that the annular latch 162 is temporarily prevented from rotating, for example as a result of ice accumulation in the vicinity of the annular latch 162, it is desirable to provide strain relief to prevent permanent damage to components in the lockable latching device 110. In the embodiment shown in FIG. 8, the C-spring 164 has sufficient rigidity to rotate the annular latch 162 under normal operating conditions but is configured to allow elastic deformation of either the first radially-projecting end 214 or the second radially-projecting end 216 before plastic deformation of the lever 142 occurs if the annular latch is held immovable.

Figure 12A:
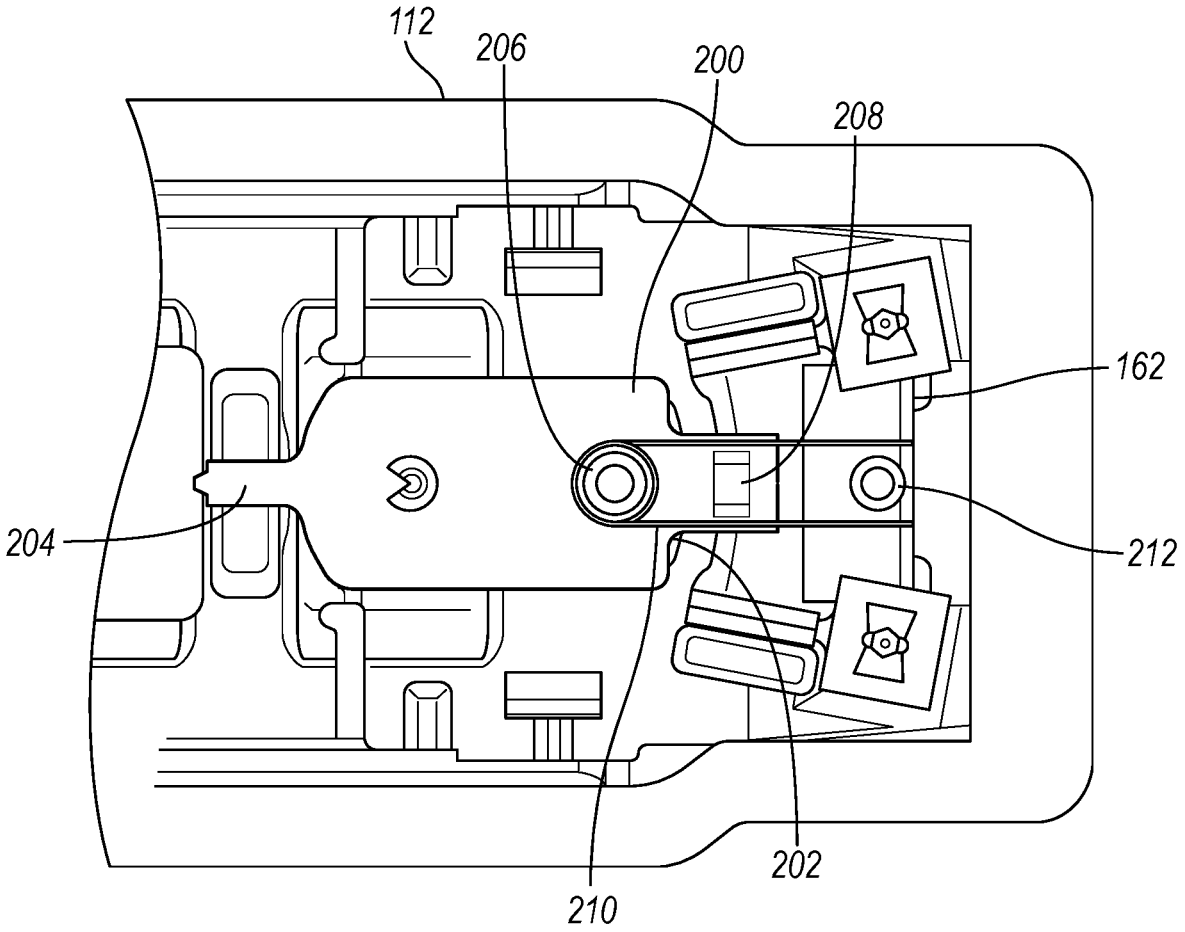
FIG. 12*a* and FIG. 12B are illustrations of an alternative lever, according to an exemplary embodiment.
Figure 12B:
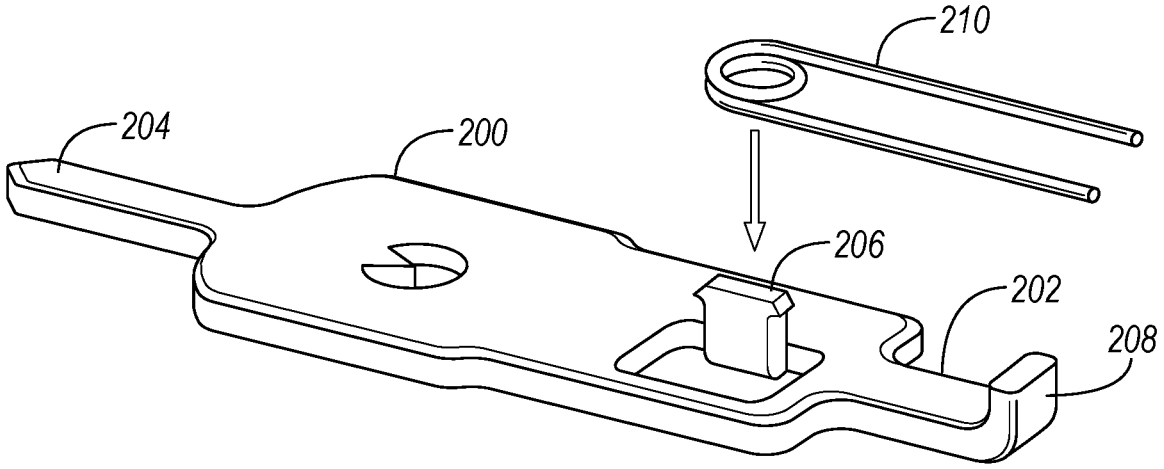

In an alternative embodiment as shown in FIGS. 12*a* and 12*b*, the lever 142 may be replaced with a lever 200. The lever 200 includes a first arm 202 and a second arm 204. The second arm 204 is configured to interact with the slider 150 and with the detent spring 148 in a manner analogous to the second arm 146 of the lever 142 described earlier. The first arm 202 includes a mounting tab 206 for a torsion spring 210. The first arm 202 also includes a locating tab 208. As shown in FIG. 12*a*, the annular latch 162 includes a projection 212. Under normal operating conditions, the torsion spring 210 has sufficient rigidity to contact the projection 212 and urge rotation of the annular latch 162 as the lever 200 rotates. The torsion spring 210 is configured to elastically deform before plastic deformation of the lever 200 occurs if the annular latch is held immovable.

It may be desirable to sense the position of a door that is associated with the lockable latching device 110. To accomplish this, the lockable latching device 110 may further include a sensor 218 as shown in FIG. 8. In an embodiment, the sensor 218 may be a sensor that is responsive to a magnetic field, including but not limited to a reed switch or a Hall effect sensor. A source of the magnetic field may be provided to generate a first state of the sensor 218 with the door in a first position and to generate a second state of the sensor 218 with the door in a second position. As a non-limiting example of the source of the magnetic field, a permanent magnet (not shown) may be provided on the door (not shown) or on the plunger 122. Electrical connection to the sensor 218 may be provided by additional connector pins 156 and/or terminals 154. In a non-limiting exemplary embodiment, the sensor 218 may be mounted to the electrical circuit 172.

While the best modes for carrying out the disclosure have been described in detail, those familiar with the art to which this disclosure relates will recognize various alternative designs and embodiments for practicing the disclosure within the scope of the appended claims.

A lockable latching device of the present disclosure offers several advantages. These include a design to remove electrical excitation from the SMA elements to prevent overheating the elements, and provision for strain relief to prevent permanent damage in the event of temporary interference with the movement of the annular latch.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A lockable latching device comprising:

a body defining a cavity therein and having a central longitudinal axis;

a plunger disposed within the cavity and having a first end and a second end spaced apart from the first end, wherein the plunger is translatable with respect to the body along the central longitudinal axis between: an open position in which the second end is disposed within the cavity; and a closed position in which the second end protrudes from the cavity;

an annular rotator disposed along the central longitudinal axis and configured for rotating the plunger about the central longitudinal axis;

an annular latch abutting the annular rotator and transitionable between: an unlocked state in which the annular latch is positioned about the central longitudinal axis such that the plunger is transitionable between the open position and the closed position; and a locked state in which the annular latch is positioned about the central longitudinal axis such that the plunger is not transitionable between the open position and the closed position;

a first element formed from a first shape memory alloy that is transitionable between a first austenite crystallographic phase and a first martensite crystallographic phase in response to a first activation signal, the first element having a first end affixed relative to the body and a second end affixed relative to the body such that the first end of the first element is at a fixed location relative to the second end of the first element;

a second element operably connected to the annular latch and formed from a second shape memory alloy that is transitionable between a second austenite crystallographic phase and a second martensite crystallographic phase in response to a second activation signal, the second element having a first end affixed relative to the body and a second end affixed relative to the body such that the first end of the second element is at a fixed location relative to the second end of the second element; and a force transmission mechanism operably connected to the first element, the second element, and the annular latch, the force transmission mechanism configured to transition the annular latch from the unlocked state to the locked state in response to the first activation signal, the force transmission mechanism further configured to transition the annular latch from the locked state to the unlocked state in response to the second activation signal.

2. The lockable latching device of claim 1, wherein the force transmission mechanism comprises a slider configured to move relative to the body, wherein the slider is urged by the first element to move in a first linear direction in response to the first activation signal and wherein the slider is urged by the second element to move in a second linear direction opposite the first linear direction in response to the second activation signal.

3. The lockable latching device of claim 2, wherein the force transmission mechanism further comprises a lever rotatable about a pivot axis that is fixed relative to the body, wherein the lever is urged by the slider to rotate in a first rotational direction in response to the first activation signal and wherein the lever is urged by the slider to rotate in a second rotational direction opposite the first rotational direction in response to the second activation signal.

4. The lockable latching device of claim 3, wherein the lever is operably coupled to the annular latch.

5. The lockable latching device of claim 4, wherein the lever is operably coupled to the annular latch by a compliant coupling configured to elastically deform if the annular latch is prevented from moving.

6. The lockable latching device of claim 5, wherein the compliant coupling comprises a strain relief ring coupled to the annular latch.

7. The lockable latching device of claim 5, wherein the compliant coupling comprises a spring member extending from the lever to the annular latch.

8. The lockable latching device of claim 3, wherein the lever rotates within a plane that is parallel with the central longitudinal axis.

9. The lockable latching device of claim 2, wherein an electrical terminal affixed to and moveable with the slider is configured to cooperate with an electrical circuit to remove the first activation signal or the second activation signal when the slider moves past a predetermined position.

10. The lockable latching device of claim 1, further comprising a detent spring configured to maintain the annular latch in its most recently commanded locked state or unlocked state in the absence of both the first activation signal and the second activation signal.

11. The lockable latching device of claim 1, further comprising an electrical circuit configured to receive a DC voltage and to provide the first activation signal if the DC voltage has a first polarity and to provide the second activation signal if the DC voltage has a second polarity that is opposite the first polarity.

12. The lockable latching device of claim 1, wherein the plunger is configured to engage a door, wherein the lockable latching device further comprises a sensor configured to indicate the position of the door.

13. The lockable latching device of claim 12, wherein the sensor comprises a reed switch.

14. The lockable latching device of claim 12, wherein the sensor comprises a Hall effect device.

15. An actuator comprising:

a body;

a first element formed from a first shape memory alloy that is transitionable between a first austenite crystallographic phase and a first martensite crystallographic phase in response to a first activation signal, the first element having a first end affixed relative to the body and a second end affixed relative to the body such that the first end of the first element is at a fixed location relative to the second end of the first element;

a second element formed from a second shape memory alloy that is transitionable between a second austenite crystallographic phase and a second martensite crystallographic phase in response to a second activation signal, the second element having a first end affixed relative to the body and a second end affixed relative to the body such that the first end of the second element is at a fixed location relative to the second end of the second element; and a force transmission mechanism operably connected to the first element and the second element.

16. The actuator of claim 15, wherein the force transmission mechanism comprises a slider configured to move relative to the body, wherein the slider is urged by the first element to move in a first linear direction in response to the first activation signal and wherein the slider is urged to move by the second element in a second linear direction opposite the first linear direction in response to the second activation signal.

17. The actuator of claim 16, wherein the force transmission mechanism further comprises a lever rotatable about a pivot axis that is fixed relative to the body, wherein the lever is urged by the slider to rotate in a first rotational direction in response to the first activation signal and wherein the lever is urged by the slider to rotate in a second rotational direction opposite the first rotational direction in response to the second activation signal.

18. The actuator of claim 16, wherein an electrical terminal affixed to and moveable with the slider is configured to cooperate with an electrical circuit to remove the first activation signal or the second activation signal when the slider moves past a predetermined position.

19. The actuator of claim 15, further comprising a detent spring configured to maintain the force transmission mechanism in its most recently commanded position in the absence of both the first activation signal and the second activation signal.

20. The actuator of claim 15, further comprising an electrical circuit configured to receive a DC voltage and to provide the first activation signal if the DC voltage has a first polarity and to provide the second activation signal if the DC voltage has a second polarity that is opposite the first polarity.

* * * * *